United States Patent [19]

Bisbing

[11] Patent Number: 4,583,775

[45] Date of Patent: Apr. 22, 1986

[54] LATCH ASSEMBLY HAVING PULL-UP ACTION

[75] Inventor: Robert H. Bisbing, Springfield, Pa.

[73] Assignee: Southco, Inc., Concordville, Pa.

[21] Appl. No.: 779,313

[22] Filed: Sep. 24, 1985

Related U.S. Application Data

[63] Continuation of Ser. No. 610,961, May 16, 1984, abandoned.

[51] Int. Cl.[4] ..... E05C 5/02

[52] U.S. Cl. ..... 292/64

[58] Field of Search ..... 292/61, 62, 63, 64, 292/65, 58, 59, 68, 69, 212

[56] References Cited

U.S. PATENT DOCUMENTS

| | | | |
|---|---|---|---|
| 550,221 | 11/1895 | Euphrat | 292/58 |
| 1,907,625 | 5/1933 | Vogt | 70/128 X |
| 3,397,000 | 8/1968 | Nakanishi | 292/61 |
| 3,402,958 | 9/1968 | Barry | 292/62 |

*Primary Examiner*—Richard E. Moore

*Attorney, Agent, or Firm*—Paul & Paul

[57] ABSTRACT

A latch of the pull-up type for a cabinet door is latched and unlatched by turning the latch in one direction or the other. When the door is in latched position, rotating the latch in the unlatching direction initially causes a spring-biased shaft, which carries a latching pawl, to move axially inwardly. This inward movement of the shaft is permitted because a sleeve cam having cam slots is moved rotationally to present inwardly sloping cam surfaces to opposite ends of a cross pin which is mounted on the shaft and which functions as a cam follower. The shaft is prevented from rotating on its own axis until the cross pin, which also functions as a motion-control pin, is moved axially inwardly a sufficient distance to escape from axial motion-control slots provided in a motion-control sleeve which is mounted coaxially on the shaft. When the motion-control pin reaches the inward ends of the axial motion-control slots, the opposite ends of the cross pin are able to move laterally into lateral motion-control slots provided in the motion-control sleeve, thereby to allow the shaft and the latch pawl to move pivotally out of the way of the cabinet frame. To latch the door, the action described takes place in reverse order.

20 Claims, 10 Drawing Figures

LATCH ASSEMBLY HAVING PULL-UP ACTION

This application is a continuation, of application Ser. No. 610,961, filed 5/16/84, now abandoned.

BACKGROUND OF THE INVENTION

This invention relates to door or panel latches for cabinets and the like. The latch is of the type adapted to be mounted along the edge of the door which overlaps the cabinet frame. The latch has a latching finger or pawl which is swingable over the inside of the cabinet frame at the door opening to lock the door against the cabinet frame by a pull-up action.

Pull-up latches of the foregoing type are disclosed in Barry et al U.S. Pat. No. 2,860,904, Barry U.S. Pat. No. 3,302,964 and Barry U.S. Pat. No. 3,402,958.

The pull-up latches shown in the above-identified U.S. patents may be characterized as lift-and-turn latches. One of the disadvantages of the lift-and-turn latches of the type shown in the first two patents, i.e., U.S. Pat. Nos. 2,860,904 and 3,302,964, is that it is possible when opening the latch to turn the handle before lifting it, and, conversely, when latching, it is possible to push the handle down before turning it. These possibilities can cause problems.

The last of the above three patents, namely, U.S. Pat. No. 3,402,958, represents an improvement over the lift-and-turn latches of the earlier two patents in that, in the later U.S. Pat. No. 3,402,958, extensions are provided on the sides of the handle. These extensions enclose the square head of a sleeve, thereby to prevent rotation of the handle when in the DOWN or locked position. However, provided sufficient torque force is applied, it is possible to break the extensions off the handle by turning it before lifting it. When the handle is in the UP or opening position, cooperating surfaces on the handle and sleeve provide a detent action. Even with these improvements, it is still possible to latch the fastener with the pawl in the wrong position.

CROSS-REFERENCE TO RELATED APPLICATION

This application is related to and describes a modification of my invention described in my co-pending patent application, Ser. No. 574,041, filed Jan. 26, 1984, by Robert H. Bisbing, entitled Latch Assembly Having Pull-Up Action, and assigned to the assignee of the present application.

SUMMARY OF THE PRESENT INVENTION

A principal object of the present invention is to provide a latch of the pull-up type which represents a modification of the latch shown in my co-pending patent application, Ser. No. 574,041, filed Jan. 26, 1984.

A more specific object is to provide a second form of latch of the pull-up type, similar but different from the latch shown in my aforesaid co-pending patent application. In both forms, the clamping action is accomplished by means of a single turning motion, in contrast to the two-step lift-and-turn motion of the prior art latches.

Another object is to provide a latch of the pull-up type which does not project outwardly from the door as far as does the handle type of pull-up latch shown in my aforesaid co-pending patent application.

Yet another object is to provide a pull-up latch which may be operated by a tool, as distinguished from a pivotal handle.

The foregoing objects are accomplished by a latch mechanism which uses a single cross pin mounted on and carried by the shaft which carries the latching pawl. This single cross pin functions both as a cam follower and also as a motion-control pin. A cam slot is provided for each end of the cross pin. Two intersecting motion-control slots are provided in a sleeve. One of the slots is axial; the other is lateral. When the cross pin is in the axial slot, only axial movement of the latching pawl is possible. When the cross pin is in the lateral recess, only angular movement of the latching pawl is possible. The structural arrangement is such that during a single continuous turning motion of the latch handle, the cross pin transfers from one of the motion-control slots to the other, thereby to achieve, in sequence, during unlatching, axial and then angular movement of the latching pawl, and to achieve, in sequence, during latching, angular and then axial movement of the latching pawl. The sequential steps may, however, be reversed by modifying the latch structure.

In contrast to the pull-up latch shown in my co-pending application Ser. No. 574,041, the latch of the present application employs a single cross pin which performs a dual function, namely, it functions as a motion-control pin and also as a cam follower.

DETAILED DESCRIPTION OF THE PREFERRED EMBODIMENTS

Figure 1:
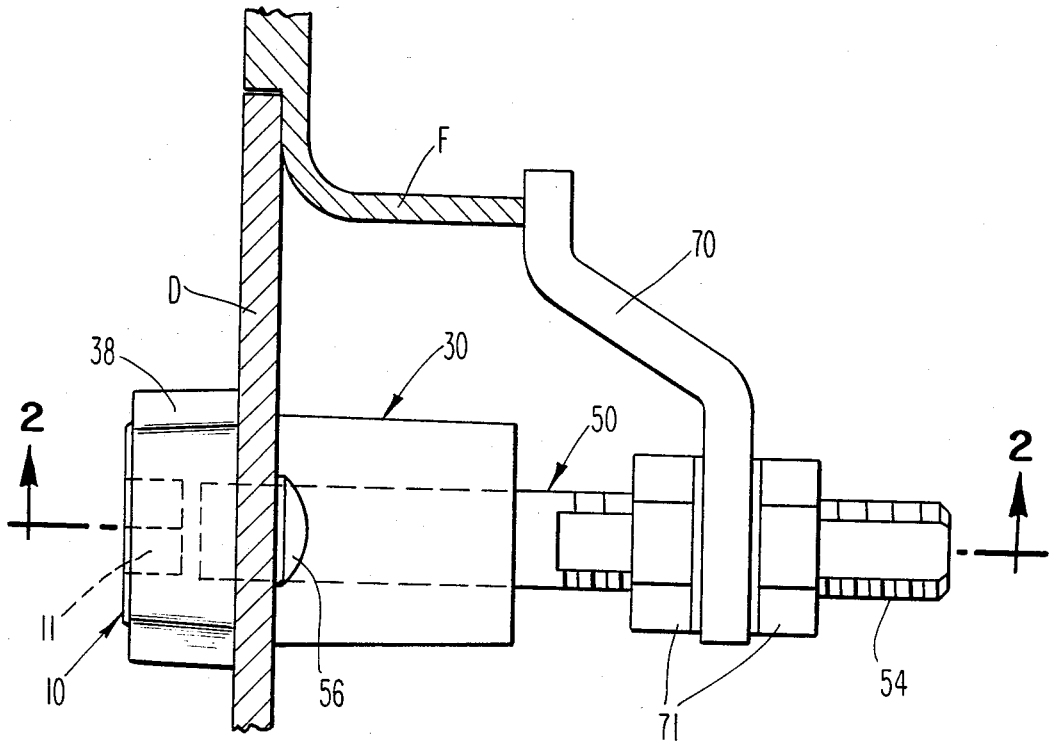
FIG. 1 is a top plan view of the new pull-up latch shown mounted on the door of the cabinet and in fully latched position.
Figure 2:
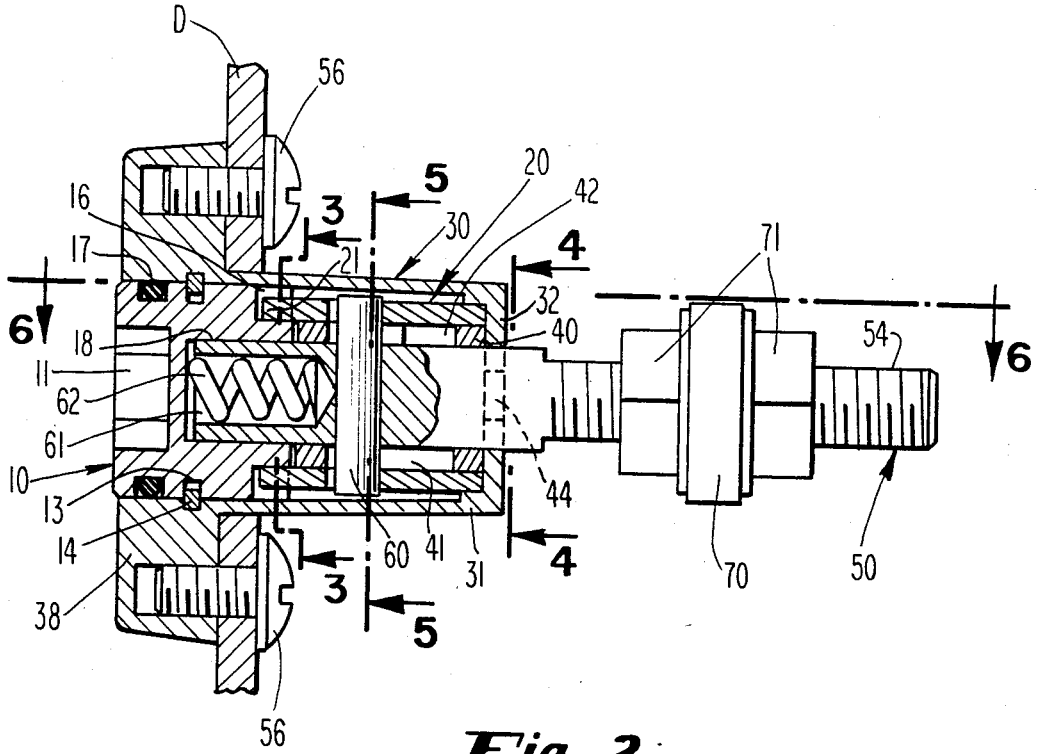
FIG. 2 is an elevational view, in section, looking along the line 2—2 of FIG. 1.

The major components of the pull-up latch of the present invention are a drive plug or cap 10, a support base 30, a rotatable slotted sleeve cam 20, a fixed slotted motion-control sleeve 40, a shaft 50, and a latch pawl 70. Shaft 50 carries a cross pin 60 which functions both as a cam follower and also as a motion-control pin.

In the drawing, cap 10 is shown to have an hexagonal recess 11 for receiving a hexagonal drive tool. The recess could, of course, have other shapes. For example, the recess could be square or octagonal.

The cap 10 is cylindrical and has a cylindrical bore 18 which receives the outward end of shaft 50. Cap 10 is rotatable within support base 30 but is prevented from movement in the axial direction of shaft 50 by a retaining ring 14 which is received within grooves 13 located in registered positions in cap 10 and base 30. The inward end of cap 10 is provided with a pair of notches 16 which receive ears 21 which project axially outwardly from a sleeve-like cam 20. Thus, when cap 10 is rotated, as by a suitable tool inserted into recess 11, the sleeve-like cam 20 is also rotated.

The sleeve-like cam 20 is provided with a pair of cam slots 25 spaced 180 degrees apart circumferentially. Each of the slots 25 runs in a direction which has both circumferential and axial components.

Positioned coaxially between shaft 50 and the sleeve-like cam 20 is a fixed motion control sleeve 40 having a pair of axial slots 41 and a pair of circumferential slots 42. One slot of each pair is spaced 180 degrees from the other. The inward end of each axial slot connects with one end of one of the circumferential slots. The motion-control sleeve 40 is prevented from moving rotationally relative to support base 30 by a pair of ears 44 which project axially inwardly into slots in the inward end 32 of the support base 30.

The support base 30 is a generally hollow cylindrical component which is mounted on the door D of the cabinet as by screws 56 inserted into ear portions 38 of an outer portion located on the outside of the door D, while a sleeve portion 31 projects inwardly through a hole or opening in door D. The inward end 32 of support base 30 is closed except for a central hole through which shaft 50 passes. The inward ends of the fixed motion-control sleeve 40 and rotatable sleeve-like cam 20 abut against the end 32 of the support base.

The pairs of slots 41 and 42 in the fixed motion-control sleeve 40 function respectively as axial motion-control slots and as lateral motion-control slots. These motion-control slots receive in sequence, in one order or the other, the opposite ends of cross pin 60, as will be described.

Shaft 50 is an elongated shaft, the outer or head end of which is received within the cavity or bore 18 in cap 10. Shaft 50 projects inwardly through the hole in the inward end 32 of support base 30, and beyond, with the shaft so supported that the center axis of the shaft coincides with the center axis of motion-control sleeve 40 and cam 20. The inner end 54 of shaft 50 is threaded, and thereon is mounted a latching pawl 70, with the position of the pawl on the shaft being held in place by a pair of nuts 71 and being axially adjustable.

The relative positions of motion-control sleeve 40 and cam 20 could be reversed. That is, motion-control sleeve 40 could be radially outside of cam 20 rather than within as shown.

Mounted on shaft 50 is the cross pin 60 which projects laterally in both directions from the shaft. Cross pin 60 functions as a cam follower and also as a motion-control pin.

The outward end of shaft 50 is provided with a center bore 61 in which a coil compression spring 62 is placed. The outward end of compression spring 62 bears against the cap 10. Thus, compression spring 62 biases shaft 50 inwardly toward the unlatching position. This biasing force maintains the ends of cross pin 60 in close contact with the inner wall 22 of cam slot 25. The biasing spring 62 is desirable but not essential since even without the spring the ends of the cross pin 60 would follow the cam slots 25. However, the cam slots 25 have a width which is somewhat greater than the diameter of the cross pin 60 and accordingly the biasing spring is useful in maintaining the cross pin against the inward wall of the slots. Cross pin 60 controls whether, in response to rotation of the cap 10, shaft 50 and pawl 70 will move only axially or only angularly. This is determined by whether the opposite ends of pin 60 are within the axial motion-control slots 41 or in the lateral motion-control slots 42.

OPERATION

Figure 3:
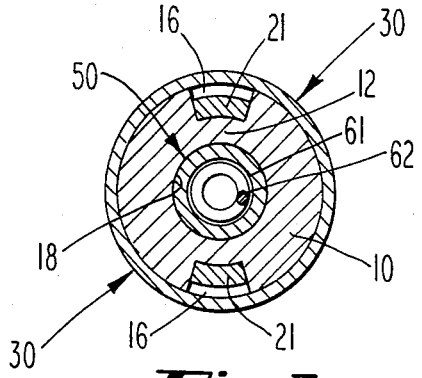
FIG. 3 is a view, in section, looking outwardly along the line 3—3 of FIG. 2.
Figure 4:
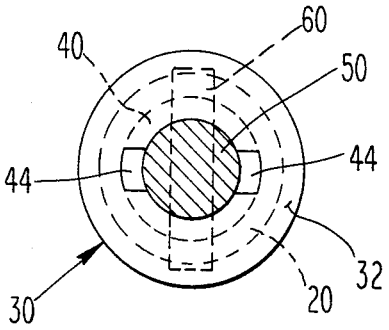
FIG. 4 is a view, in section, looking outwardly along the line 4—4 of FIG. 2.
Figure 5:
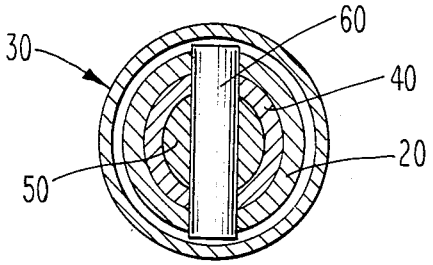
FIG. 5 is a view, in section, looking outwardly along the line 5—5 of FIG. 2.

As seen best in FIGS. 1 and 3, when cap 10 is rotated, as by a tool inserted in hex recess 11, the sleeve-like cam 20 will be driven rotationally due to the projection of cam ears 21 into the notches 16 in cap 10. When cam 20 is rotated, cross pin 60 is moved, but whether the movement is axial or lateral is dependent upon whether the ends of pin 60 are in the axial or lateral slots of the motion-control sleeve 40.

Figure 6:
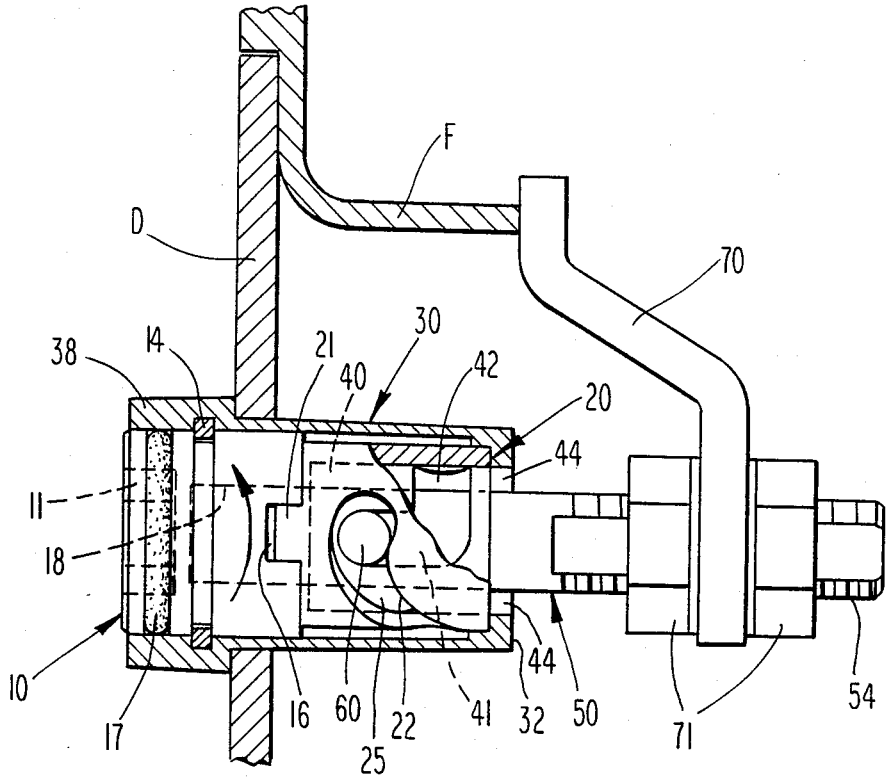
FIG. 6 is a view, partly in section, showing the pull-up latch mounted on the door of the cabinet and in fully latched position.

In FIG. 6 the latch is shown in the fully latched position in which the latch pawl 70 is in alignment with, and in engagement with, the cabinet frame F. When in the latched position, cap 10 is at its fully clockwise position, as viewed looking from the left in FIG. 6, and the two opposite ends of cross pin 60 project through the axial slots 41 in the motion-control sleeve 40 and into the closed outmost ends of cam slots 25.

To unlatch the door D from the cabinet frame F, cap 10 is turned in the counterclockwise direction in the direction of the arrow shown in FIG. 6. When this is done, cap 10 and cam 20 rotate as a unit. The cross pin 60 cannot move rotationally because its opposite ends are within the diametrically-opposed axial slots 41 of the fixed motion-control sleeve 40. As a result, when cam 20 is rotated counterclockwise, the force of the biasing spring 62 causes the opposite ends of pin 60 to follow the inward walls 22 of the opposed cam slots 25, and, as a result, pin 60, and hence also shaft 50 and latch pawl 70, move in the inward unlatched direction until the ends of the pin 60 reach the lateral slots 42.

Figure 7:
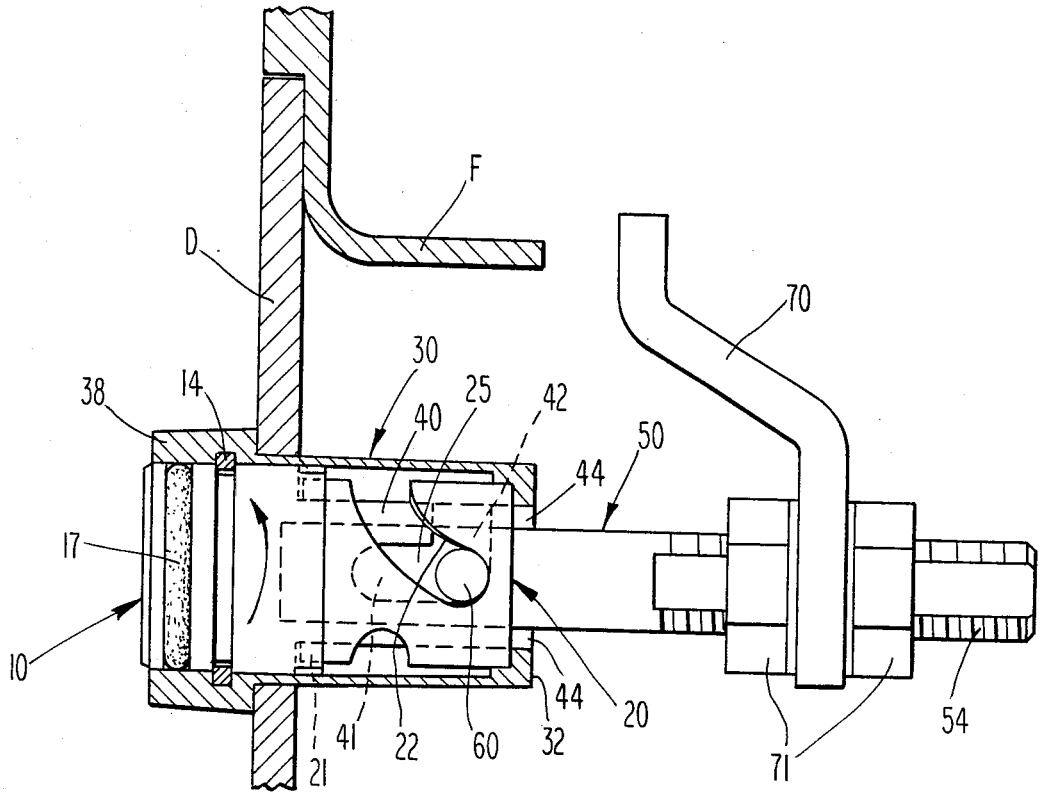
FIG. 7 is a view similar to that of FIG. 6 but showing the latch in partly unlatched position.
Figure 8:
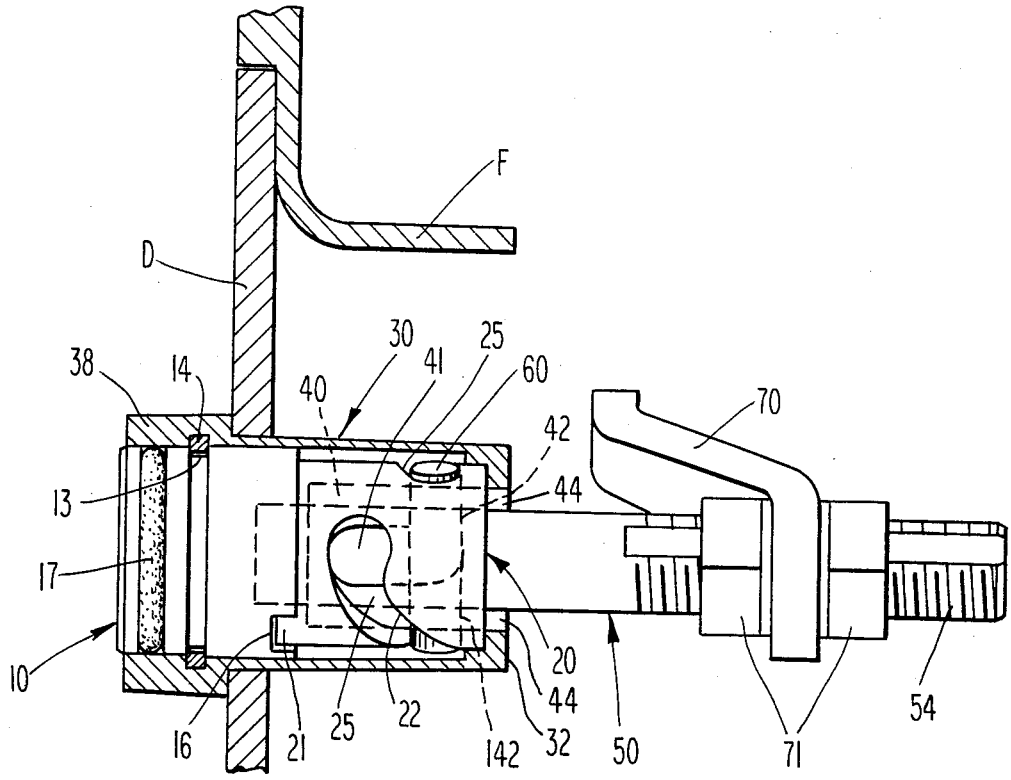
FIG. 8 is a view similar to that of FIGS. 6 and 7 but showing the latch in fully unlatched position.

After cap 10 and cam 20 have been rotated as a unit through 120 degrees from the position shown in FIG. 6, cross pin 60 has moved axially inwardly to the position shown in FIG. 7, and is now aligned with the opposed lateral slots 42. Further rotation of cap 10 and cam 20 now causes rotational movement of cross pin 60, shaft 50 and pawl 70, as the opposed ends of pin 20 move into the opposed lateral slots 42. In this manner, pawl 70 is moved out of alignment with frame member F and, after 60 degrees of rotation, the door D is fully unlatched, as is illustrated in FIG. 8. Cap 10 is now 180 degrees from the fully latched position shown in FIG. 6.

The latching action is simply the reverse of the unlatching action which has just been described. On latching, as cap 10 is turned clockwise, the opposite ends of cross pin 60 move laterally in the lateral slots 42 and shaft 50 rotates on its axis. Then the cross pin 60 translates axially outwardly. These sequential motions are caused by the walls 22 of the cam slots 25 which urge the ends of the cross pin 60 through the lateral motion-control slots 42 in the lateral or circumferential direction until the ends of the cross pin abut against the edge of the axial motion-control slots 41. Therafter, walls 22 of the cam slots 25 urge the ends of the cross pin 60 axially outwardly through axial slots 41. Thus, cam 20 and the motion-control slots 42 and 41 cause the angular and axial motions to take place in sequence, in response to turning the cap 10 in the latching direction in one continuous motion.

In the form of latch assembly shown in FIGS. 1–8, the support base 30 is secured to the door D by a pair of screws 56 which are inserted into ears 38 of the portion of base 30 which is located on the outer surface of the door. In some installations, a latch assembly with a smaller profile on the outer surface of the door may be desirable. In such cases, the support base may be given the form shown in FIGS. 9 and 10.

Figure 9:
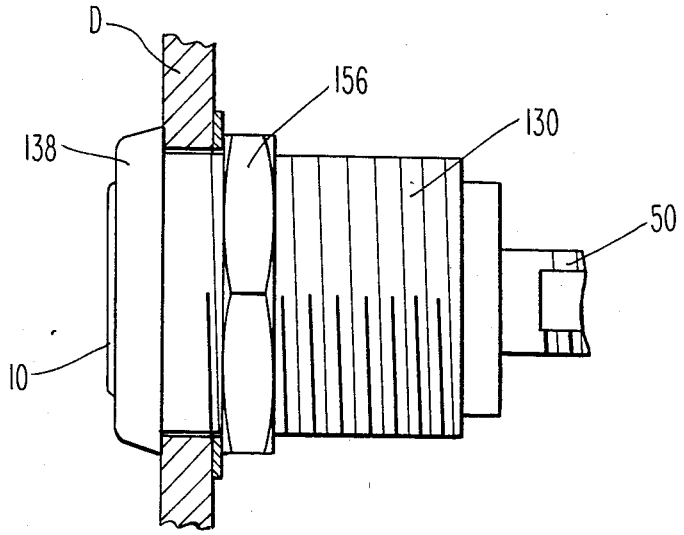
FIGS. 9 and 10 are views similar to FIGS. 1 and 2 but illustrating a modified form of support base having, on the outer surface of the door D, a head which is substantially smaller than the head shown in FIGS. 1 and 2.
Figure 10:
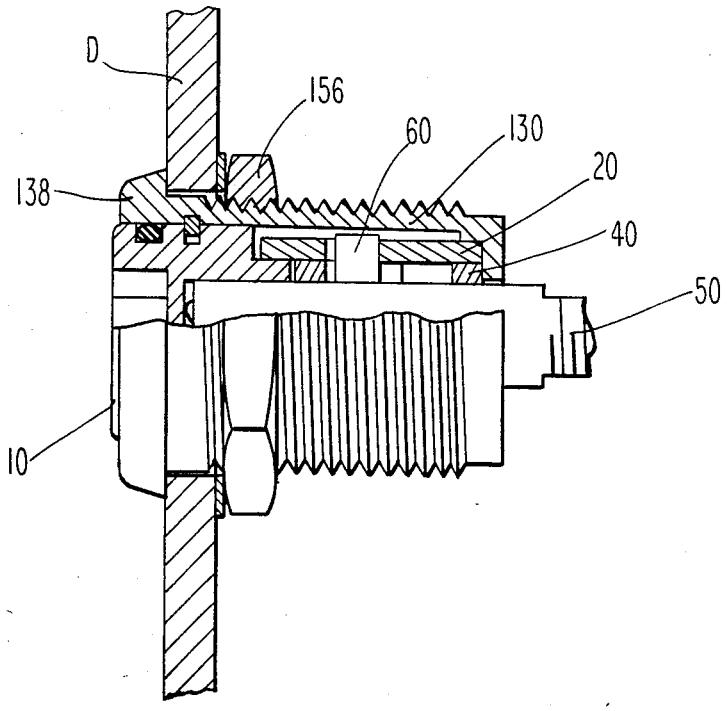

In FIGS. 9 and 10, the support base, designated 130, has a portion 138 on the outer surface of the door D which is circular in shape. There are no ears projecting in opposite directions for receiving screws. In FIGS. 9 and 10, the sleeve portion 131, which extends inwardly through the hole in the door, is externally threaded and a nut 156 is screwed onto the sleeve until the nut abuts against the inner surface of the door. A lock washer 157 may desirably be used between the nut and the door. In this manner, the latch assembly is securely mounted onto the door. In all other respects, the latch assembly of FIGS. 9–10 is similar to the latch assembly of FIGS. 1–8.

The new latch has been described as mounted on the movable door. This is the preferred location. However, a latch embodying the basic concept of the present invention could be mounted on the fixed cabinet rather than on the door. In such case, the shaft and latch pawl would be moved angularly to engage a keeper mounted on the inside of the door and then axially inwardly to pull the door to tightly closed position. This is the reverse of the axial motion used to pull the door tightly shut when the latch is mounted on the door.

What is claimed is:

1. A pull-up latch mechanism comprising:

a. a fixed support base having an inwardly projecting sleeve;

b. a plug-type cap within said support base and coaxial with said base sleeve;

c. a shaft having its outward end supported in said cap and having an intermediate portion supported by said base sleeve, said shaft projecting in an inward direction from said base sleeve;

d. a rotatable sleeve cam coaxial within said base sleeve, said sleeve cam having diammetrically opposed cam slots;

e. a motion-control sleeve fixed within said base sleeve and coaxial with said sleeve cam;

f. a pair of diametrically opposed axially extending motion-control slots in said motion-control sleeve;

g. a pair of diametrically opposed laterally extending motion-control slots in said motion-control sleeve;

h. each of said axial motion-control slots intersecting with one of said lateral motion-control slots at a motion translation position;

i. a cross pin secured to said shaft and extending laterally in opposite directions therefrom, each opposite end of said cross pin projecting into one of said motion-control slots and into one of said cam slots;

j. means interconnecting said cap and said sleeve cam, whereby the application of torque force to said cap moves said cam rotationally;

k. whereby, in response to said cap being moved rotationally in the same one direction, rotational and axial motions are imparted sequentially to said shaft, in that order or in reverse order depending upon the direction of rotation of said cap.

2. A pull-up latch mechanism according to claim 1 wherein a latch finger is mounted on said shaft.

3. A pull-up latch mechanism according to claim 2 wherein said fixed support base is mounted on a closure member and said base sleeve projects inwardly through an opening in said closure member.

4. A pull-up latch mechanism according to claim 3 wherein biasing means are provided for biasing said shaft in one direction for maintaining said opposite ends of said cross pin in engagement with one wall of each of said cam slots.

5. A pull-up latch mechanism according to claim 4 in which said biasing means urges said shaft in the inward unlatching direction.

6. A pull-up latch mechanism according to claim 5 in which said cap is provided with a non-circular recess for receiving the non-circular head of a torque drive tool.

7. A pull-up latch mechanism according to claim 6 in which a retainer ring is provided to prevent relative axial movement between said support base and said cap.

8. A pull-up latch mechanism according to claim 7 in which said means interconnecting said cap and said sleeve cam comprise ears projecting from one into notches in the other.

9. A pull-up latch mechanism according to claim 8 wherein said motion-control sleeve is fixed against rotation relative to said base sleeve by ears projecting from one into notches in the other.

10. A pull-up latch mechanism according to claim 8 wherein said ears project axially outwardly from said sleeve cam into notches in said cap.

11. A pull-up latch mechanism according to claim 9 wherein said ears project axially inwardly from said motion-control sleeve into notches in said base sleeve.

12. A pull-up latch mechanism according to claim 1 wherein each of said cam slots extends in a direction having both axial and circumferential components.

13. A pull-up latch according to claim 1 wherein said rotatable sleeve cam is positioned between said fixed motion-control sleeve and said support base sleeve.

14. A pull-up latch mechanism according to claim 3 in which said fixed support base has ears for receiving screws for securing said support base to said closure member.

15. A pull-up latch mechanism according to claim 3 in which said base sleeve is externally threaded and is secured to said closure member by a nut screwed onto said base sleeve.

16. A pull-up latch mechanism comprising:

a. a fixed motion-control sleeve having in its wall a pair of diametrically opposed axially extending slots and a pair of diametrically opposed laterally extending slots, each of said axial slots intersecting with one of said lateral slots at a motion translation position;

b. a rotatable cam sleeve coaxial and coextensive with at least a portion of said motion-control sleeve, said cam sleeve having diametrically opposed cam slots each of which extends in a direction having both axial and circumferential components;

c. a shaft coaxial within said sleeves, said shaft projecting therefrom in one axial direction;

d. a cross pin mounted in said shaft and extending laterally in opposite directions therefrom, and projecting into each of said cam slots and into each of said motion-control slots; and e. means for applying a torque force to said cam sleeve for moving said cam sleeve rotationally, whereby, in response to said cam sleeve being moved rotationally in the same one direction, rotational and axial motions are imparted sequentially to said shaft, in that order or in reverse order depending upon the direction of rotation of said cam sleeve.

17. A pull-up latch mechanism acording to claim 16 wherein a latch finger is mounted on said shaft.

18. A pull-up latch mechanism according to claim 17 wherein said means for applying a torque force to said cam sleeve includes a plug type cap coaxial with said cam sleeve and means connecting said cap to said cam sleeve.

19. A pull-up latch mechanism according to claim 18 in which said cap is provided with a recess for receiving the head of a torque drive tool.

20. A pull-up latch mechanism according to claim 19 wherein biasing means are provided for biasing said shaft in one direction for maintaining opposite ends of said cross pin in engagement with a wall of each of said cam slots.

* * * * *